US008240095B1

(12) United States Patent
Meyer

(10) Patent No.: US 8,240,095 B1
(45) Date of Patent: Aug. 14, 2012

(54) DECK ASSEMBLY WITH LINER PANEL

(75) Inventor: Brian Jacob Meyer, Columbia, SC (US)

(73) Assignee: Consolidated Systems, Inc., Columbia, SC (US)

( * ) Notice: Subject to any disclaimer, the term of this patent is extended or adjusted under 35 U.S.C. 154(b) by 0 days.

(21) Appl. No.: 13/006,144

(22) Filed: Jan. 13, 2011

Related U.S. Application Data

(60) Provisional application No. 61/296,620, filed on Jan. 20, 2010.

(51) Int. Cl.
*E04C 2/52* (2006.01)
*E04B 9/00* (2006.01)

(52) U.S. Cl. ..... 52/220.2; 52/220.3; 52/443; 52/450; 52/451

(58) Field of Classification Search ..... 52/220.2, 52/220.3, 443, 449, 450, 451
See application file for complete search history.

(56) References Cited

U.S. PATENT DOCUMENTS

| | | | | | |
|---|---|---|---|---|---|
| 910,757 | A | * | 1/1909 | Wilson | 52/336 |
| 1,998,425 | A | | 4/1935 | McNeil | |
| 3,550,332 | A | | 12/1970 | Wiesman | |
| 3,707,088 | A | | 12/1972 | King et al. | |
| 3,713,261 | A | | 1/1973 | Landis et al. | |
| 3,812,636 | A | * | 5/1974 | Albrecht et al. | 52/334 |
| 3,859,770 | A | | 1/1975 | Chambers et al. | |
| 3,967,426 | A | | 7/1976 | Ault et al. | |
| 4,085,558 | A | * | 4/1978 | Albrecht | 52/451 |
| 4,454,692 | A | * | 6/1984 | Ault | 52/220.4 |
| 4,685,264 | A | | 8/1987 | Landis | |
| 5,172,527 | A | | 12/1992 | Ault | |
| 5,259,157 | A | * | 11/1993 | Ault | 52/145 |
| 5,491,946 | A | * | 2/1996 | Landis et al. | 52/336 |
| 5,713,157 | A | | 2/1998 | van Leeuwen et al. | |
| 6,357,191 | B1 | | 3/2002 | Ault et al. | |
| 6,691,482 | B1 | | 2/2004 | Ault | |
| 7,137,224 | B2 | | 11/2006 | Rasmussen et al. | |
| 7,146,920 | B1 | * | 12/2006 | Ryan et al. | 114/85 |
| 7,241,094 | B1 | | 7/2007 | Potts et al. | |
| 7,328,667 | B1 | * | 2/2008 | Ryan et al. | 114/85 |
| 7,603,814 | B1 | | 10/2009 | Hartmann et al. | |
| 7,739,844 | B2 | | 6/2010 | Gharibeh et al. | |
| D622,417 | S | * | 8/2010 | Ryan | D25/122 |
| 7,774,990 | B1 | * | 8/2010 | Castellanos | 52/57 |
| 7,793,477 | B1 | | 9/2010 | Potts | |
| 7,810,293 | B2 | * | 10/2010 | Gibbar et al. | 52/309.7 |

* cited by examiner

*Primary Examiner* — Mark Wendell
(74) *Attorney, Agent, or Firm* — Michael A. Mann; Nexsen Pruet, LLC

(57) ABSTRACT

A deck system is made by joining deck units, each having a hat-shaped profile fastened to the topside of a profiled bottom panel. The bottom panel has nestable or interlocking side laps and one or more "dove-tail" shaped recesses formed therein. These recesses, which may be concave upward or downward, give the deck unit additional strength as a defined, confined location for use to run conduit and to provide vertical support for vertical loads. The deck system may be combined with a layer of concrete for use as a floor or roof.

18 Claims, 5 Drawing Sheets

DECK ASSEMBLY WITH LINER PANEL

PRIORITY CLAIM

Priority is claimed to U.S. provisional patent Ser. No. 61/296,620, filed Jan. 20, 2010, which is incorporated herein in its entirety by reference.

BACKGROUND OF THE INVENTION

In construction, deck units are used to construct a deck system. A deck unit is comprised of one or more profiled forms made of steel that is handled as a single building component. Deck systems are simply a group of deck units that are fastened together in sufficient number to make the deck system of desired size.

The deck unit or deck system may support a layer of structural concrete in order to be used as a roof or floor, or a layer of lightweight insulating concrete in order to be used as a roof or may be used without the concrete.

Deck units include hat-shaped, profiled panels which are fastened to an exposed bottom panel to form closed cells within the deck units. The interiors of these cells may be used as air ducts, for running conduit for utilities and cabling, and to carry sound-absorbing materials.

Large open spaces, such as airport terminal areas and stadiums often have ceilings made of closed cellular deck systems. Often, these deck systems will also support hanging fixtures such as lighting, signs and sprinkler pipes.

There is a continual need for stronger deck systems that can span greater distances and have more capabilities while still possessing aesthetic qualities for public places.

SUMMARY OF THE INVENTION

The present invention is a deck unit comprising one or more top hat portions of various sizes and shapes joined to an exposed dove-tail bottom panel. The bottom panel includes at least one or more dovetail-shaped recess. A deck system is made by joining the present deck units.

Each deck unit includes a central hat-shaped panel with integral first and opposing second side laps of an attached bottom panel. The bottom panel is dimensioned to span the underside of one or more hat-shaped portions, and to have hidden side laps that nest with side laps of the hat-shaped portion. The deck units are fastened together to form the deck system. Importantly, the bottom panel has at least one "dove-tail"-shaped recess formed in it. These recesses, which may be concave upward or downward, provide additional strength to the deck unit and deck system, as well as a defined, confined recess in the bottom panel for use in concealing and running conduit and also in providing vertical support for lighting and other hanging type vertical loads when the present deck system is used as a roof/ceiling or floor/ceiling.

A feature of the present invention is the dove-tail shaped recesses formed in the bottom panel and throughout its length. The configuration of these dove-tailed panels and hat-shaped deck profiles together substantially increase stiffness to the deck system while providing the clean, plank-like appearance of the exposed underside of the deck system. Furthermore, the dove-tailed recesses provide additional capabilities to the deck system. Because the recess may be only partially closed, that is, it may have a narrow gap when viewed from below, it allows the deck system to support and conceal connections for exterior ceiling lighting and signage and aids in attenuating sound energy.

An advantage of the present system is that, from below, it has the appearance of planks, which especially in a large ceiling is aesthetically pleasing, while nonetheless providing functional spaces for acoustical materials and structural strength for the ceiling load over such long spans.

These and other features and their advantages will be readily apparent to those skilled in the art of metal deck system fabrication and construction from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

The present invention is a deck unit including at least one top-hat profile attached to a bottom panel for use in making a deck unit for a roof or floor. The bottom panel includes at least one dovetail-shaped recess. Adding the top hat profile to the bottom panel with dovetail recesses substantially increases the strength of the deck unit. The present deck unit can be joined together to form a deck system, which can be used with or without a layer of concrete depending on specifications for the application of use. A deck unit with more than one top hat profile attached to one bottom panel makes assembling the deck system faster, and the present description of embodiments of the present invention and accompanying drawings will show plural top hat profiles in each deck unit. However, the present deck unit may alternatively have just one or more than two top hat profiles.

Figure 1:
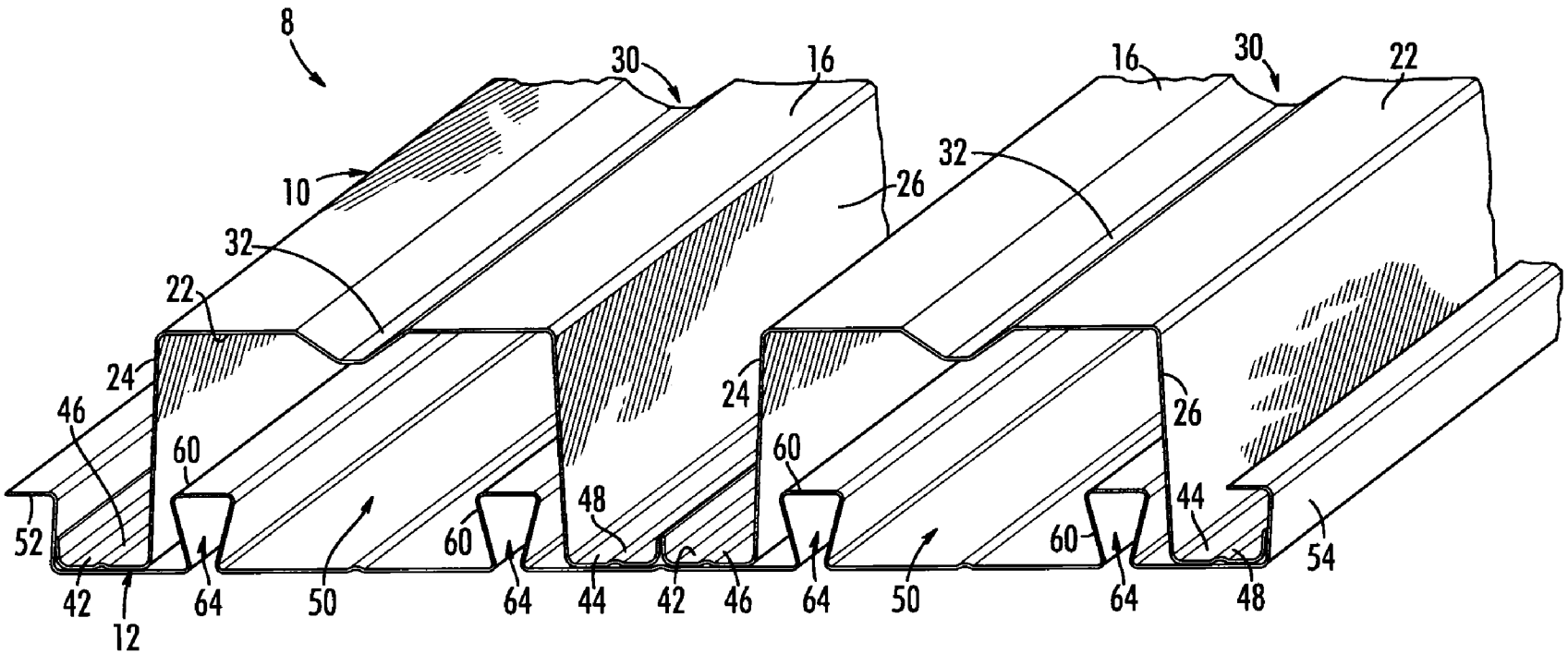
FIG. 1 is a top perspective view of a deck unit comprising two individual top hat profiles joined to a single exposed bottom panel, according to an embodiment of the present invention.
Figure 2A:
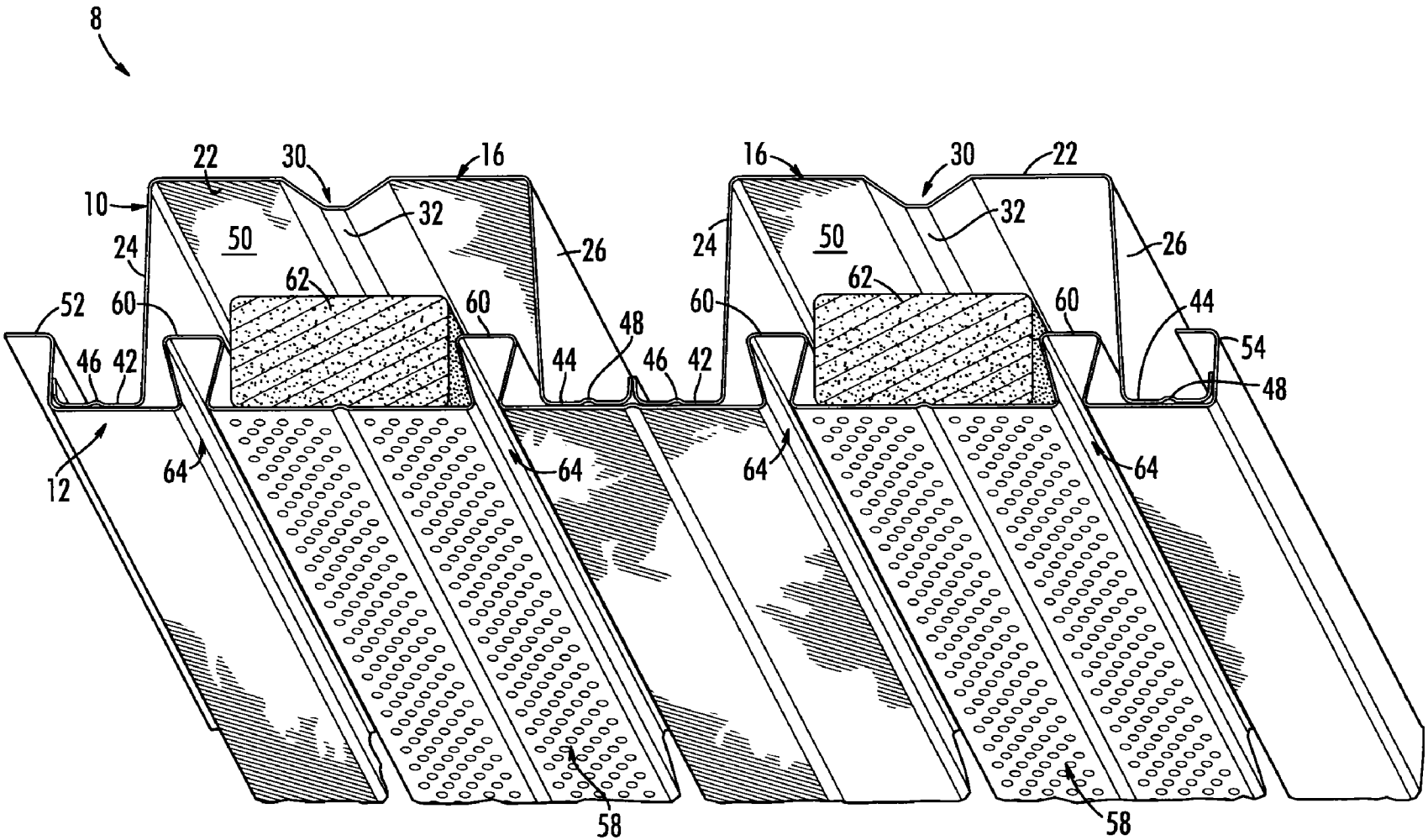
FIG. 2A is a bottom perspective view of a deck unit including two individual top hat profiles joined to a bottom panel with concave upward and open dove-tail recesses, according to an embodiment of the present invention.
Figure 2B:
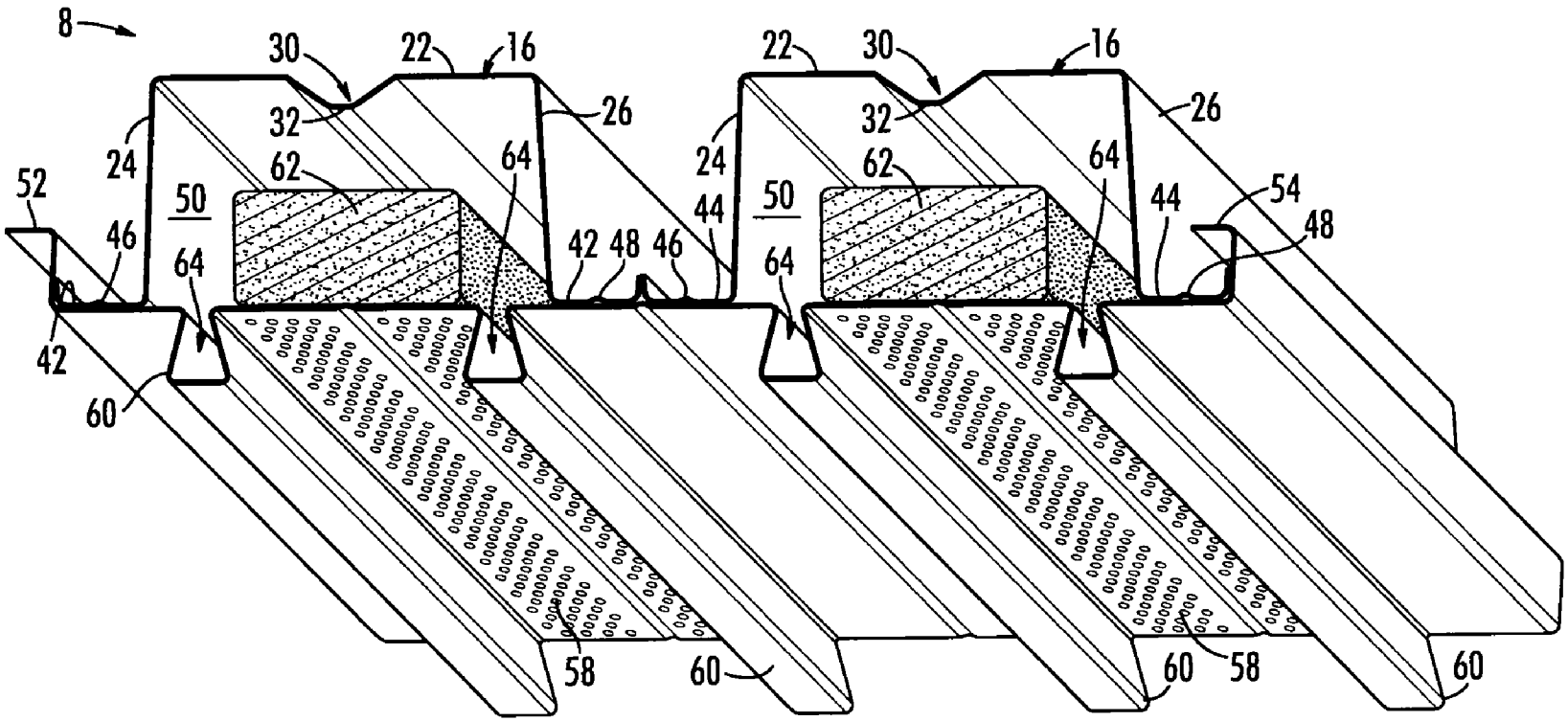
FIG. 2B is a bottom perspective view of a deck unit including two individual top hat profiles joined to a bottom panel with concave downward and closed recesses, according to an alternative embodiment of the present invention.

Referring now to the figures, there is shown in FIGS. 1, 2A and 2B, top and bottom perspective views, respectively, of a deck unit 8. Each deck unit 8 includes two top hat profiles 10 attached to one bottom panel 12 and has a distance end to end that runs the length of a specified span of a ceiling or roof. Deck unit 8 is handled as a single unit and combined with other deck units 8 to construct a deck system of the specified width.

Although deck unit 8 is shown as having two individual top hat-shaped profiles 10, it may be made with one top hat profile 16. Top hat profiles 16 are integrally joined and both may be formed from a single profiled sheet of metal, preferably steel.

Each top hat profile 16 includes a top flange 22 integrally formed with two side walls 24, 26. Side walls 24, 26, may be nearly at right angles to top flange 22, but may be canted slightly outwardly from top to bottom as shown in the figures so as to be spaced slightly farther apart at the bottom of top hat profiles 16 and slightly closer together at top flange 22.

Top flange 22 may have one or more grooves 30 formed therein, trapezoidal in shape with the bottom 32 of groove 30 being smaller than the opening at the top of the groove 30, and side walls 36, 38 of groove 30 may be symmetrically flared outwardly in the upward direction. A groove 30 adds stiffening to top hat profile 16

Each top hat profile 16 has bottom flanges 42, 44, and each of them may have a bead 46, 48, formed therein to add stiffening. Deck unit 8 is formed by securing top hat profiles 10 on bottom panel 12. Each bottom flange 42, 44 of each top hat profile 16 of deck unit 8 is connected integrally to bottom panel 12 by a mechanical fastening process, such as by welding for example.

Bottom panel 12 is also preferably a profiled sheet of metal, such as steel, that covers the bottom openings of top hat profiles 10 of a deck unit 8 to define spaces or cells 50 therebetween. Bottom panel 12 also provides side laps 52, 54, for fastening adjacent deck units 8 together. Side laps 52, 54 are formed so that a side lap 52 of one bottom panel 12 nests within or interlocks with a side lap 54 of an adjacent bottom panel 12. By the term nesting, it is meant that the length of one side lap 52 fits within and follows closely with the length of the other side lap 54, that the contours of one side lap 52 follow closely in the same directions and has the same changes in direction as the contours of the other side lap 54. By the term interlocking, it is meant that a portion of one side lap 52, is crimped to the other side lap 54 so that the materials of which the two side laps 52, 54, are made penetrates each others boundaries.

Bottom panel 12 may be perforated so as to have an array of holes 58 formed therein for absorbing sounds (see FIGS. 2A and 2B) into cells 50.

Bottom panel 12 has at least one, and preferably more than one, dove-tail shaped recesses 60 formed therein, and may have two dovetail recesses 60 for each top hat profile 16 of deck unit 8 in registration with each cell 50. Recesses 60 may be concave upward or concave downward. Recesses are concave upward when viewed from below bottom panel 12 as they extend into cells 50, as shown in FIG. 2A. Dovetail recesses 60 have narrow openings 64 and may extend concave downward, to the exterior of cell 50 below bottom panel 12 expanding in the downward direction, as shown in FIG. 2B.

Bottom panel 12 at dove-tail recesses 60 provide a nearly-closed, well-defined, protected conduit for piping, wiring, cables, optic fibers or sound insulating material 62 (FIGS. 2A and 2B). Bottom panel 12 at recesses 60 may be used to support vertical loads from below bottom panel 12, such as signage 68 and lighting 70 (see FIG. 3).

Figure 3:
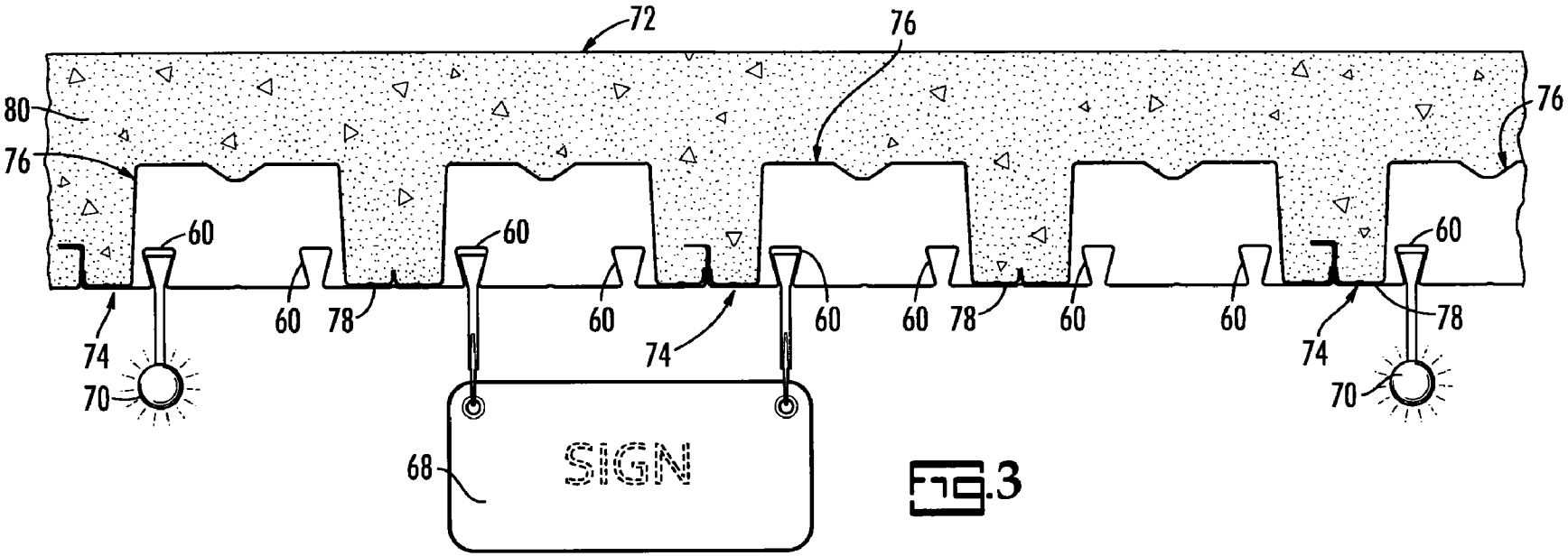
FIG. 3 is a side view of a portion of deck system serving as a ceiling, with concrete placed above, in an embodiment of the present invention.

FIG. 3 illustrates a deck system 72 formed of at least two deck units 74, each defined by two top hat profiles 76 with a dovetail bottom panel 78. As illustrated in FIG. 3, a layer of concrete 80 overlays deck system 72 when deck system 72 is to function as a composite roof or floor.

Figure 4:
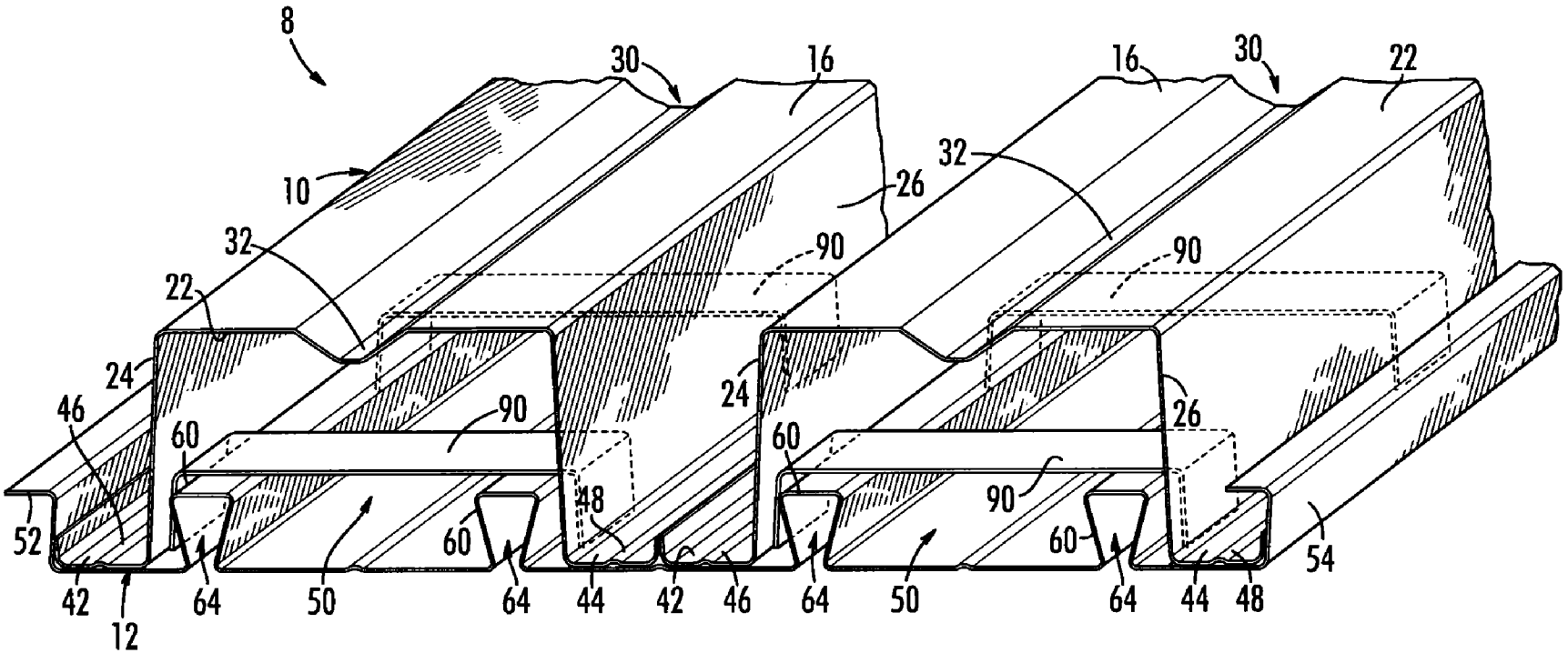
FIG. 4 is a perspective, partially-cut-away view of the deck unit of FIG. 1 with deck struts inside the first and second top hat profiles, according to an embodiment of the present invention.

In addition, employing bottom panels 12 with dove-tail recesses 60 attached to a top hat profile adds significantly to the strength of deck system 72 and allows for longer spans as well as greater functionality. Recesses 60 may be open and concave upward as illustrated in FIGS. 2A and 3 or closed and concave downward, as illustrated in FIG. 2B. If concave upward, the top of the dove-tail recesses may be used as added support for metal deck struts 90, as disclosed in application Ser. No. 11/347,484 filed Feb. 3, 2006 for a metal deck strut system, as seen in FIG. 4, which is identical to FIG. 1 except for the addition of struts 90.

The superior strength of the present invention over an otherwise similar bottom panel with dove-tail recesses alone, is illustrated by the following example. Assuming a uniform load of 30 pounds per square foot and using 20 gauge steel, the span limit of a dovetailed panel is 12.5 feet. With a 20 gauge steel top hat profile attached to the dove-tailed panel, the span limit for the same loading increases to 20.5 to 26.5 feet depending on the height of the hat profile.

In addition to its great strength, the present invention also adds to the functional aesthetics of a ceiling of a building covering a large area, such as an airport terminal or an arena. The concave upward dovetail recesses establish narrow gaps in the otherwise smooth panel liners to create a plank look from below. This plank look gives the viewer a better indication of the perspective of the area as well as provides an aesthetically-pleasing, clean-looking treatment to the ceiling. Concave downward dovetail recesses provide wider gaps which provide a similar visual effect. In both cases (concave upward and concave downward dove-tail recesses) the bottom panel also hides the sidelap connections between adjacent deck units.

Dove-tail recesses also provide a convenient way to suspend lighting fixtures and signage, to serve as a hidden chase way for electrical or plumbing purposes, and as a sound-absorbing chamber or place for inserting acoustic materials for absorbing sounds from below.

Those familiar with steel deck system construction will appreciate that many modifications and substitutions can be made to the foregoing preferred embodiments of the present invention without departing from the spirit and scope of the present invention, defined by the appended claims.

What is claimed is:

1. A deck unit for use within a deck system, said deck unit having a length, said deck unit comprising:

(a) a top hat profile having a top flange, opposing side walls depending from said top flange, opposing first and second bottom flanges extending from said opposing side walls; and (b) a profiled bottom panel extending from said first bottom flange of said top hat profile to said second bottom flange, said bottom panel having opposing side laps attached to said opposing first and second bottom flanges, respectively, of said top hat profile thereby enclosing said top hat profile to define an enclosed cell within said deck unit, said bottom panel having at least one dove-tail recess formed therein between said opposing first and second side walls and forming part of said cell, said at least one dove-tail recess of said cell extending said length of said deck unit.

2. The deck unit as recited in claim 1, wherein said at least one dove-tail recess is concave upward.

3. The deck unit as recited in claim 1, wherein said at least one dovetail recess is concave downward.

4. The deck unit as recited in claim 1, wherein said bottom panel is perforated.

5. The deck unit as recited in claim 4, wherein said cell carries acoustic insulation.

6. The deck unit as recited in claim 1, wherein said top hat profile carries a deck strut, said deck strut extending between and being attached to said first side wall and said opposing second side wall.

7. The deck unit as recited in claim 6, wherein said at least one dove-tail recess is concave upward.

8. The deck unit as recited in claim 7, wherein said at least one dove-tail recess supports said deck strut.

9. A deck unit for use within a deck system, said deck unit having a length, said deck unit comprising:

(a) a first top hat profile and second top hat profile, said first and said second top hat profiles each having a top flange, opposing first and second side walls depending from said top flange, opposing first and second bottom flanges extending from said opposing first and second side walls, respectively, said first and second top hat profiles being continuously formed in side-by-side relation with said second bottom flange of said first top hat profile being integrally formed with said first bottom flange of said second top hat profile; and (b) a bottom panel extending from said first bottom flange of said first top hat profile to said second bottom flange of said second top hat profile, said bottom panel having opposing side laps attached to said first bottom flange of said first top hat profile and said second bottom flange of said second top hat profile, respectively, thereby enclosing said first and second top hat profiles to define a first and a second enclosed cell, respectively, said bottom panel having at least one dove-tail recess formed between said first and second side walls of said first top hat profile as part of said first cell.

10. The deck unit as recited in claim 9, wherein said at least one dove-tail recess is concave upward.

11. The deck unit as recited in claim 9, wherein said at least one dove-tail recess is concave downward.

12. The deck unit as recited in claim 9, wherein said bottom panel is perforated.

13. The deck unit as recited in claim 12, wherein said first and said second cells carry acoustic insulation.

14. The deck unit as recited in claim 9, wherein said first and said second top hat profiles each carry a deck strut, said deck strut extending between and being attached to said opposing side walls.

15. The deck unit as recited in claim 14, wherein said at least one dove-tail recess is concave upward.

16. The deck unit as recited in claim 15, wherein said at least one dove-tail recess supports said deck strut.

17. A deck unit for use within a deck system, said deck unit having a length, said deck unit comprising:

(a) a first top hat profile and second top hat profile, said first and said second top hat profiles each having a top flange, opposing first and second side walls depending from said top flange, opposing first and second bottom flanges extending from said opposing first and second side walls, respectively, said first and second top hat profiles being in side-by-side relation, with said second bottom flange of said first top hat profile; and (b) a bottom panel extending from said first bottom flange of said first top hat profile to said second bottom flange of said second top hat profile, said bottom panel having opposing side laps attached to said first bottom flange of said first top hat profile and said second bottom flange of said second top hat profile, respectively, thereby enclosing said first and second top hat profiles to define a first and a second enclosed cell, respectively, said bottom panel having at least one dove-tail recess formed between said first and second side walls of said first top hat profile as part of said first cell, said at least one dove-tail recess of said first cell extending said length of said deck unit.

18. The deck unit as recited in claim 17, wherein said second bottom flange of said first top hat profile and said first bottom flange of said second top hat profile are attached to said bottom panel.

* * * * *